US007857432B2

(12) United States Patent
Stephens et al.

(10) Patent No.: US 7,857,432 B2
(45) Date of Patent: Dec. 28, 2010

(54) DROP GENERATOR

(75) Inventors: Terrance Lee Stephens, Molalla, OR (US); Brian Edward Williams, Woodburn, OR (US); John Milton Brookfield, Newberg, OR (US); James Dudley Padgett, Lake Oswego, OR (US)

(73) Assignee: Xerox Corporation, Norwalk, CT (US)

( * ) Notice: Subject to any disclaimer, the term of this patent is extended or adjusted under 35 U.S.C. 154(b) by 146 days.

(21) Appl. No.: 12/391,446

(22) Filed: Feb. 24, 2009

(65) Prior Publication Data

US 2010/0214374 A1 Aug. 26, 2010

(51) Int. Cl.
*B41J 2/045* (2006.01)

(52) U.S. Cl. ..... 347/68

(58) Field of Classification Search ..... 347/68, 347/69–72, 65; 400/124.14, 124.16; 310/311, 310/324, 327

See application file for complete search history.

(56) References Cited

U.S. PATENT DOCUMENTS 7,055,939 B2 * 6/2006 Norkitis et al. ..... 347/68
7,159,970 B2 * 1/2007 Watanabe ..... 347/68
2006/0256163 A1 * 11/2006 Hirota et al. ..... 347/68
2006/0284936 A1 12/2006 Darling
2007/0120896 A1 5/2007 Stephens et al.
2008/0018714 A1 1/2008 Domoto et al.

* cited by examiner

*Primary Examiner*—K. Feggins
(74) *Attorney, Agent, or Firm*—Maginot, Moore & Beck LLP

(57) ABSTRACT

A drop generator includes a pressure chamber and a flexible diaphragm plate disposed on the chamber and forming a wall of the pressure chamber. A piezoelectric transducer having a bottom surface is attached to the diaphragm plate. The diaphragm plate includes a recess that forms a perimeter around the bottom surface of the transducer that partially underlies at least one edge of the bottom surface. An inlet channel is connected to the pressure chamber and configured to direct ink to the pressure chamber from a manifold. An outlet channel is connected to the pressure chamber to receive ink from the pressure chamber and has a channel axis that is perpendicular to the diaphragm plate. The outlet channel includes a first outlet channel section and a second outlet channel section. The first outlet channel section includes a plurality of subsections having alternating diameters. The second outlet channel section includes an aperture disposed at an end thereof. The second outlet channel section has a substantially continuous cross-sectional shape and a length that is greater than a length of the first outlet channel section.

12 Claims, 3 Drawing Sheets

DROP GENERATOR

TECHNICAL FIELD

This disclosure relates generally to ink jet imaging devices, and, in particular, to drop generators for use in ink jet imaging devices.

BACKGROUND

Drop on demand ink jet technology for producing printed media has been employed in commercial products such as printers, plotters, and facsimile machines. Generally, an ink jet image is formed by selective placement on a receiver surface of ink drops emitted by a plurality of ink jets, also referred to as drop generators, implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper.

FIGS. 4A and 4B illustrate one example of a single ink jet 10 that is suitable for use in an ink jet array print head. The ink jet 10 has a body that defines an ink manifold 12 through which ink is delivered to the ink jet print head. The body also defines an ink drop-forming orifice, or nozzle, 14 together with an ink flow path from ink manifold 12 to nozzle 14. In general, the ink jet print head preferably includes an array of closely spaced nozzles 14 for use in ejecting drops of ink onto an image-receiving medium (not shown), such as a sheet of paper or a transfer drum. Ink jet print heads can have a plurality of manifolds for receiving various colors of ink.

Ink flows from manifold 12 through an inlet port 16, an inlet channel 18, a pressure chamber port 20, and into an ink pressure chamber 22. Ink leaves pressure chamber 22 by way of an outlet port 24 and flows through an outlet channel 28 to nozzle 14, from which ink drops are ejected. Ink pressure chamber 22 is bounded on one side by a flexible diaphragm 30. A piezoelectric transducer 32 is secured to diaphragm 30 by any suitable technique and overlays ink pressure chamber 22. Metal film layers 34, to which an electronic transducer driver 36 can be electrically connected, can be positioned on either side of piezoelectric transducer 32.

Piezoelectric transducer 32 is operated in its bending mode such that when a voltage is applied across metal film layers 34, transducer 32 attempts to change its dimensions. However, because it is secured rigidly to the diaphragm 30, piezoelectric transducer 32 bends, deforming diaphragm 30, thereby displacing ink in ink pressure chamber 22, causing the outward flow of ink through outlet port 24 and outlet channel 28 to nozzle 14. Refill of ink pressure chamber 22 following the ejection of an ink drop is augmented by reverse bending of piezoelectric transducer 32 and the concomitant movement of diaphragm 30, which draws ink from manifold 12 into pressure chamber 22.

To facilitate manufacture of an ink jet array print head, ink jet 10 can be formed of multiple laminated plates or sheets. These sheets are stacked in a superimposed relationship. Referring once again to FIGS. A and B, these sheets or plates include a diaphragm plate 40, which forms diaphragm 30 and a portion of manifold 12; an ink pressure chamber plate 42, which defines ink pressure chamber 22 and a portion of manifold 12; an inlet channel plate 46, which defines inlet channel 18 and outlet port 24; an outlet plate 54, which defines outlet channel 28; and an orifice plate 56, which defines-nozzle 14 of ink jet 10. The piezoelectric-transducer 32 is bonded to diaphragm 30, which is a region of diaphragm plate 40 covering ink pressure chamber 22.

One goal in the design of print heads and, in particular, ink jets incorporated into a print head, is increased printing speed. As is well known, print speed depends primarily on the packing density of the jets in the printhead (jets per unit area) and the jet operating frequency (rate that each jet can eject drops of ink). Individual jet design plays a major role in determining the maximum packing density and the maximum operating frequency. For example, increasing ink jet packing density typically requires decreasing the size of ink jet structures such as piezoelectric transducers, diaphragms, and ink chambers without decreasing the size of drops that they are capable of generating.

In previously known ink jet devices, decreasing the size of the jets to accommodate increased packing density goals may decrease jet efficiency. As used herein, jet efficiency or driver efficiency is defined as the volumetric displacement (drop size) for a given drive voltage. The drop size generated by an ink jet corresponds substantially to the degree of deflection or displacement of the transducer in response to a given drive voltage. The degree of deflection or displacement of a transducer, in turn, corresponds to the magnitude of the drive voltage with the degree of deflection increasing with increasing drive voltage. Thus, decreasing the size of the transducer in known ink jets may require an increase in the deflection of the transducer in order to maintain the same volumetric displacement which correlates to a decrease in jet efficiency for the jet.

Increasing the operating frequency of previously known ink jets may also decrease jet efficiency. For example, in order to increase the operating frequency of an ink jet, ink jet transducers are required that have a natural frequency at or above the desired operating frequency for the jets. The natural frequency of the transducer is related to transducer stiffness. Therefore, higher operating frequencies may require stiffer transducers. Stiffer transducers, in turn, may require increased drive voltages in order to deflect or displace the transducer to a sufficient degree to maintain a given volumetric displacement, or drop size.

As jet efficiency decreases, required drive voltage increases. Increased drive voltage requirements for an ink jet coupled with an increase in total number of jets may result in power supply requirements for the printer to be elevated to unacceptable or impractical levels.

SUMMARY

A drop generator for implementation in a printhead jet stack has been developed that enables a drop ejecting frequency at least 43 kHz while emitting drops having a substantially constant drop mass without decreasing ink jet packing density and without decreasing driver efficiency. In particular, in one embodiment, a drop generator includes a pressure chamber and a flexible diaphragm plate disposed on the chamber and forming a wall of the pressure chamber. A piezoelectric transducer having a bottom surface is attached to the diaphragm plate. The diaphragm plate includes a recess that forms a perimeter around the bottom surface of the transducer that partially underlies at least one edge of the bottom surface. An inlet channel is connected to the pressure chamber and configured to direct ink to the pressure chamber from a manifold. An outlet channel is connected to the pressure chamber to receive ink from the pressure chamber and has a channel axis that is perpendicular to the diaphragm plate. The outlet channel includes a first outlet channel section and a second outlet channel section. The first outlet channel section includes a plurality of subsections having alternating diameters. The second outlet channel section includes an aperture disposed at an end thereof. The second outlet channel section has a substantially continuous cross-sectional shape and a length that is greater than a length of the first outlet channel section.

BRIEF DESCRIPTION OF THE DRAWINGS

The foregoing aspects and other features of the present disclosure are explained in the following description, taken in connection with the accompanying drawings, wherein.

DETAILED DESCRIPTION

Figure 1:
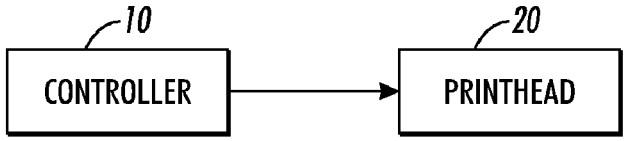
FIG. 1 is a schematic block diagram of an embodiment of a drop-on-demand drop emitting apparatus.

For a general understanding of the present embodiments, reference is made to the drawings. In the drawings, like reference numerals have been used throughout to designate like elements.

As used herein, the term "imaging device" generally refers to a device for applying an image to print media. "Print media" can be a physical sheet of paper, plastic, or other suitable physical print media substrate for images, whether precut or web fed. The imaging device may include a variety of other components, such as finishers, paper feeders, and the like, and may be embodied as a copier, printer, or a multi-function machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

FIG. 1 is schematic block diagram of an embodiment of a drop-on-demand printing apparatus that includes a controller 10 and a printhead assembly 20 that includes a jet stack for implementing a plurality of ink jets, also referred to as drop generators. The controller 10 selectively energizes the drop generators by providing a respective drive signal to each drop generator. Each of the drop generators can employ a piezoelectric transducer that is operated in a bending mode. As other examples, each of the drop generators can employ a shear-mode transducer, an annular constrictive transducer, an electrostrictive transducer, an electromagnetic transducer, or a magnetorestrictive transducer. The ink utilized in the printhead assembly 10 may be phase change ink which is initially in solid form and is then changed to a molten state by the application of heat energy. The molten ink may be stored in a reservoir (not shown) that is integral with or separate from the printhead assembly for delivery as needed to the jet stack.

The printhead assembly 20 includes a jet stack that is formed of multiple laminated sheets or plates, such as stainless steel plates. Cavities etched into each plate align to form channels and passageways that define the drop generators for the printhead. Larger cavities align to form larger passageways that run the length of the jet stack. These larger passageways are ink manifolds arranged to supply ink to the drop generators. The plates are stacked in face-to-face registration with one another and then brazed or otherwise adhered together to form a mechanically unitary and operational jet stack.

Figure 2:
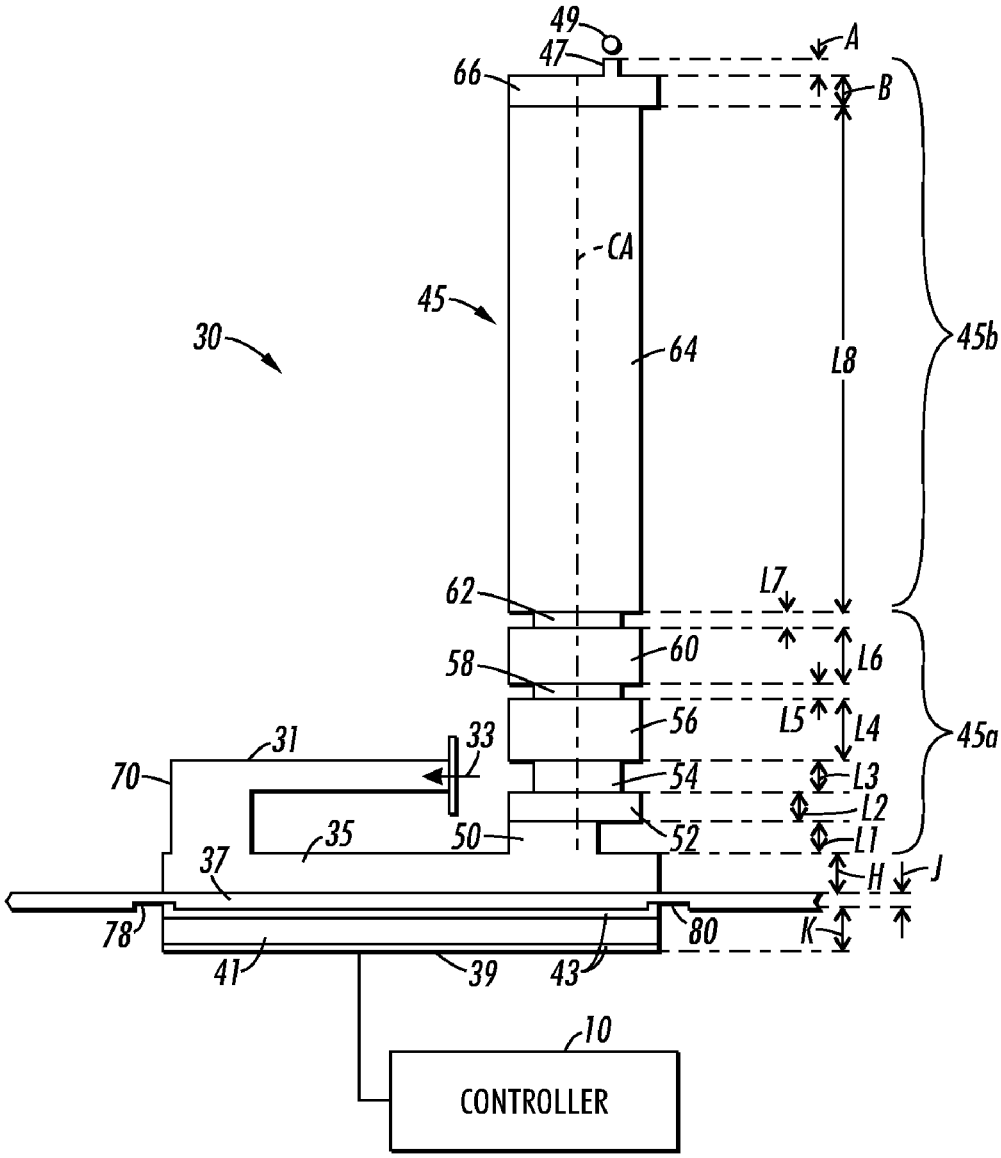
FIG. 2 is a schematic elevational view of an embodiment of a drop generator that can be employed in the drop emitting apparatus of FIG. 1.
Figure 3:
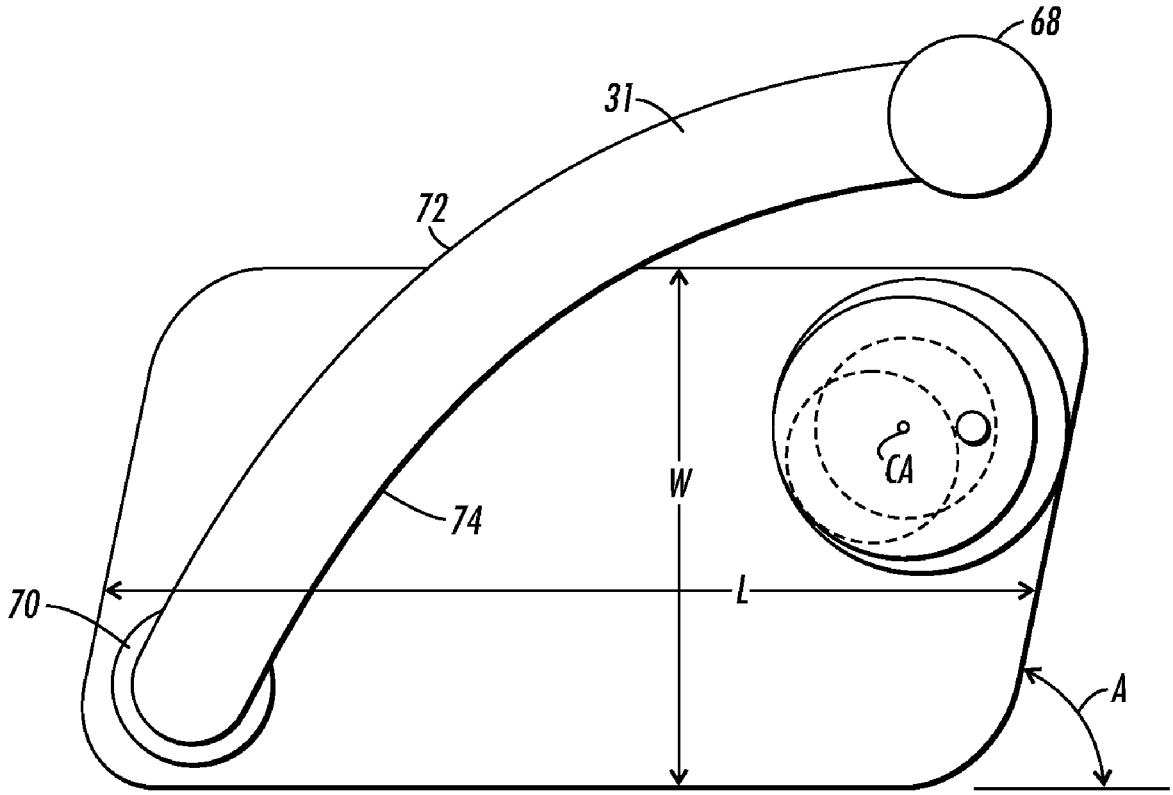
FIG. 3 is a schematic plan view of the drop generator of FIG. 2.
Figure 4A:
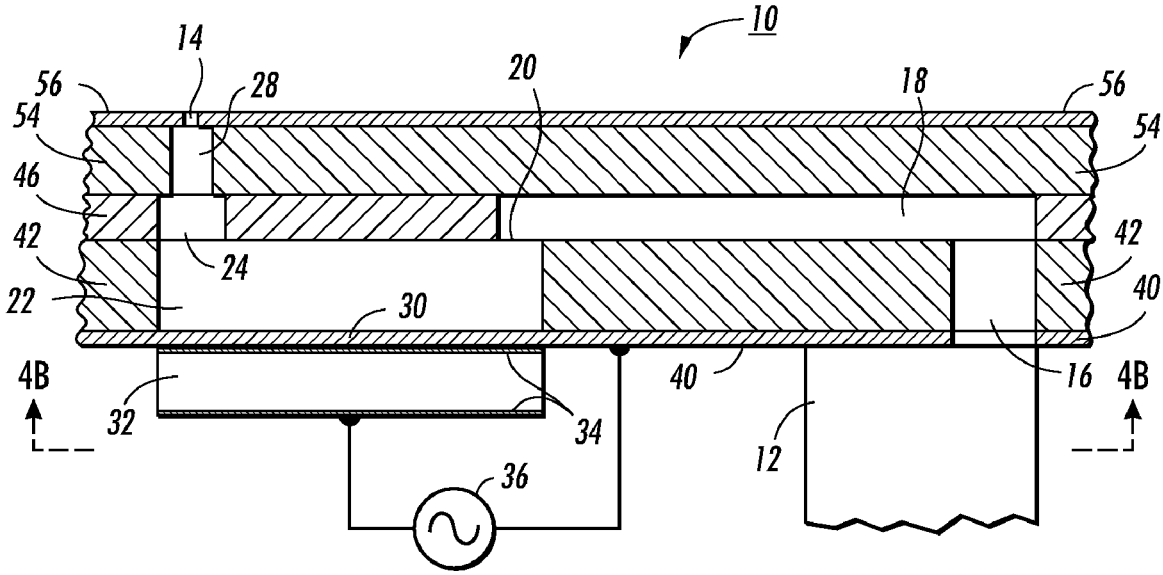
FIG. 4A PRIOR ART
FIG. 4A is a schematic side-cross-sectional view of a prior art embodiment of an ink jet.
Figure 4B:
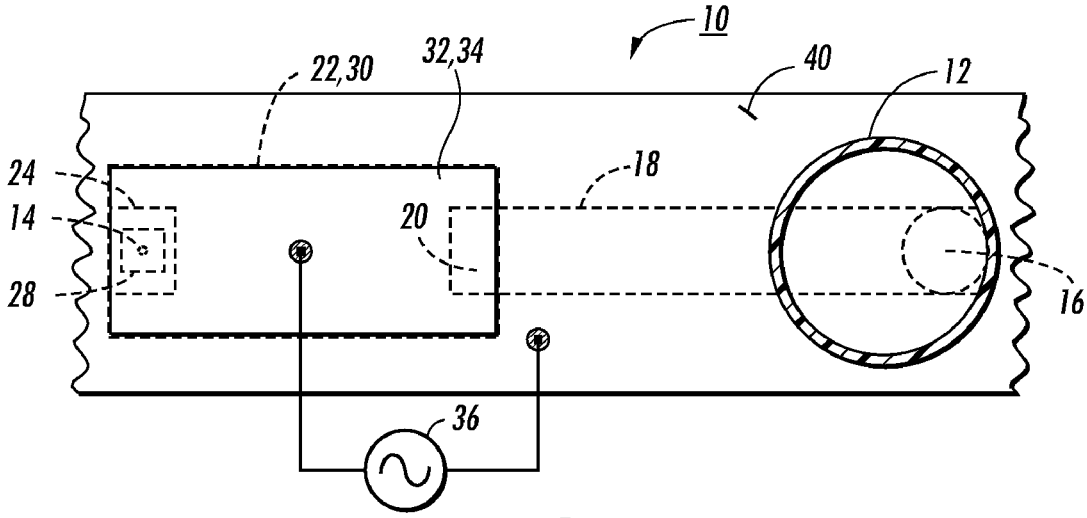
FIG. 4B PRIOR ART
FIG. 4B is a schematic to view of the prior art embodiment of the ink jet of FIG. 4A.

FIGS. 2 and 3 are a schematic plan view and a schematic elevational view of an embodiment of a drop generator 30 that may be formed by a plurality of plates of a jet stack. The drop generator 30 includes an inlet channel 31 that receives ink 33 from a manifold, reservoir or other ink containing structure. The ink 33 flows from the inlet channel into a pressure or pump chamber 35, also referred to as a body chamber, that is bounded on one side, for example, by a flexible diaphragm 37. An electromechanical transducer 39 is attached to the flexible diaphragm 37 and can overlie the pressure chamber 35, for example. The electromechanical transducer 39 can be a piezoelectric transducer that includes a piezo element 41 disposed for example between electrodes 43 that receive drop firing and non-firing signals from the controller 10. Actuation of the electromechanical transducer 39 causes ink to flow from the pressure chamber 35 to a drop forming outlet channel 45, from which an ink drop 49 is emitted toward a receiver medium (not shown) that can be a transfer surface, for example. The outlet channel 45 includes a nozzle or orifice 47 at an end thereof through which drops of ink are emitted in response to actuation of the transducer 39.

The outlet channel 45 includes a plurality of sections or segments that are defined by the different plates of the jet stack having various thicknesses and openings of the same or different cross-sectional areas. As used herein, the terms "section," "subsection," "segment," and the like, used in connection with ink channels refer to axial lengths of a particular ink channel. Ink channels may include one or multiple co-axial sections, and, ink channel sections, or segments, may include one or multiple co-axial subsections, or sub-segments. In the embodiment of FIG. 2, the outlet channel 45 includes a first outlet channel section 45*a* fluidly connected to the pressure chamber 35, and a second outlet channel section 45*b* fluidly connected to and coaxial with first outlet channel section 45*a* that includes the aperture 47 at an end thereof opposite from the pressure chamber 35. The combined length of the outlet channel 45, including the first and second outlet channel sections 45*a*, 45*b*, spans the plates of the jet stack that form the drop generators and ink manifolds of the jetstack.

With reference to FIG. 2, the first outlet channel section 45*a* may include a plurality of subsections, 50, 52, 54, 56, 58, 60, and 62. In the depicted embodiment, the subsections 50, 52, 54, 56, 58, 60, and 62 of the first outlet channel section have generally circular cross-sectional shapes that are all substantially coaxial about channel axis CA. In alternative embodiments, one or more of the outlet channel subsections may have non-circular shapes such as, for example, oval or egg shapes. The subsections 50, 52, 54, 56, 58, 60, and 62 are characterized by the fact that each of the subsections has a diameter that is different from both adjacent subsections. For example, channel subsections 52, 56 and 60 each have a first diameter, and channel subsections 54, 58, and 62, which alternate with subsections 52, 56, and 60 have a second diameter that is smaller than the first diameter. One benefit of the use of alternating diameters in the first outlet channel section is that the outlet channel is less susceptible to misalignment of the plates during assembly of the plates to form a jetstack.

In one particular embodiment, the first subsection 50 has a length L1 that is approximately 3.0 mil and an effective diameter of approximately 8.1 mil. The second subsection 52 may have a length L2 that is approximately 3.0 mil and an effective diameter of approximately 13.0 mil. The third subsection 54 may have a length L3 that is approximately 3.0 mil, and an effective diameter of approximately 9.0 mil. The fourth subsection 56 may have a length L4 that is approximately 6.0 mil, and an effective diameter of approximately 13.0 mil. The fifth subsection 58 may have a length L5 that is approximately 1.0 mil, and an effective diameter of approximately 9.0 mil. The sixth subsection 60 may have a length L6 that is approximately 6.0 mil, and an effective diameter of approximately 13.0 mil. The seventh subsection 62 may have a length L7 that is approximately 1.0 mil, and an effective diameter of approximately 9.0 mil. Thus, taken together, the first outlet channel section has a length of approximately 23.0 mil, and the subsections of the first outlet channel section alternate diameters between a diameter of approximately 9.0 mil and 13.0 mil. As used herein, the term "approximately" as applied to the dimensions, such as length, width, thickness, angle, and diameter, shall mean the stated dimension ±20%. Effective diameter refers to a diameter of a circle having the same area as the cross-sectional area of the respective outlet channel section, or subsection.

As depicted in FIG. 2, the second outlet channel section 45*b* is substantially coaxial with the first outlet channel section and includes a longitudinal subsection 64 and offset subsection 66. In particular, longitudinal subsection 64 is coaxial with subsections 50, 52, 54, 56, 58, 60, and 62 of the first outlet channel section and has a continuous cross-sectional shape which, in the embodiment of FIG. 2, is substantially circular, although a non-circular shape such as oval or egg shape may be utilized, and has an effective diameter of approximately 13.0 mil which is the same as the effective diameter of subsections 52, 56 and 60 of the first outlet channel section.

Aperture 47 is positioned at a distal end of the offset subsection 66. Similar to longitudinal subsection 64, the offset subsection 66 has a circular cross-sectional shape although a non-circular shape such as oval or egg shape may be utilized. In the exemplary embodiment, the center point of the offset channel subsection 66 is slightly displaced from the axis CA to allow flexibility in the positioning of the aperture with respect to the outlet channel. The aperture 47 does not have to be offset relative to the axis CA, and, in some embodiments, the offset outlet channel section may be removed and the longitudinal subsection 64 may be extended to the aperture plate.

In the embodiment of FIG. 2, the longitudinal subsection 64 has a length L8 that enables the channel subsection 64 to extend through one or more plates of the jetstack that, in addition to forming longitudinal subsection 64 of outlet channel 45, forms the ink manifold (not shown) within the jetstack for supplying ink to the drop generator. Thus, the longitudinal subsection 64 has a length that corresponds substantially to a thickness of the jetstack ink manifold and that is greater than the combined length of the subsections 50, 52, 54, 56, 58, 60, and 62 of the first outlet section. In one embodiment, the longitudinal subsection 64 has a length L8 that is approximately 49.0 mil. The offset outlet channel section 66 may have a length B that is approximately 3.0 mil, and an effective diameter of approximately 14.7 mil. The nozzle or aperture 47 may have a length A of approximately 1.5 mil, and an effective diameter of approximately 1.5 mil.

Referring now to FIG. 3, the ink chamber 35 may have a generally parallelogram shape with rounded corners. In alternative embodiments, however, the ink chamber may have other suitable shapes including, for example, a generally rectangular or square shape. In one embodiment, the ink chamber 35 may have a thickness H of approximately 4.0 mil. The flexible diaphragm 37 that bounds one side of the ink chamber 35 has a thickness J that is approximately 1.5 mil. The electromechanical transducer 39 that is attached to the flexible diaphragm 37 has a thickness K of approximately 3.75 mil. Additionally, the diaphragm 37 includes relief features 78, 80 in the form of recesses or kerfs that form a perimeter around the transducer that reduces sensitivity to transducer displacement errors and helps to isolate the transducer 39 from the transducers of neighboring drop generators in order to increase the driver efficiency. The relief features 78, 80 have a depth, or thickness, of approximately 0.8 mil and a width of approximately 7.0 mil.

The ink chamber 35, diaphragm (within perimeter defined by relief features 78, 80), and the transducer have lengths and widths that were selected to satisfy driving voltage and array packaging requirements without negatively impacting the ink jet frequency response. In one embodiment, the ink chamber has a width W (FIG. 3) of approximately 45.1 mil, and a length L (FIG. 3) of approximately 25.5 mil. The diaphragm 37 has a width (in the same dimension as the width W of the ink chamber) of approximately 45.1 mil, and a length that is approximately 25.5 mil. The transducer 39 has a width of approximately 49.0 mil, and a length of approximately 28.0 mil. The width and the length refer to those dimensions that are transverse to the axis CA of the outlet channel 45.

The inlet 31 and the outlet channel 45 may be connected to the ink chamber 35 at opposing corner regions of the generally parallelogram shaped ink chamber 35, for example. The inlet 31 may have a length between ends 68, 70 of approximately 47.2 mil, a width between sides 72, 74 of approximately 6.0 mil, and a height or thickness that is substantially the same as the thickness of the outlet channel section 54, i.e., approximately 3.0 mil. In the embodiment of FIG. 3, the parallelogram shaped ink chamber 35, diaphragm 37, and transducer 39 have a body angle A that is approximately 75.50.

The outlet channel 45 may thus have an overall length of approximately 75.0 mil. The combined length of the outlet channel spans the plates of the jet stack that form the drop generators and ink manifolds and is based on steady manifold pressure drop requirements. The effective diameter of the outlet channel sections 52, 54, 56, 58, 60, 62 and 64 alternate between an effective diameter of approximately 13.0 mil and an effective diameter of approximately 9.0 mil. The diameters and lengths of the outlet channel sections 50, 52, 54, 56, 68, 60, 62, 64, 66 were selected in order to obtain a predetermined frequency response without creating a fluidic inductance or resistance that is greater than the fluidic inductance introduced by the length, width, and thickness of the inlet channel.

A drop generator having the structure and dimensions described above may operate at a drop emitting frequency, or firing rate, of approximately 1 Hz to 43 kHz. In addition, the exemplary drop generator may emit drops having a drop mass of a 22 ng at a frequency of 43 kHz, and emit drops having a drop mass of about 18.5 ng at a frequency below approximately 38 kHz.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A drop generator comprising:

a pressure chamber;

a flexible diaphragm plate disposed on the chamber and forming a wall of the pressure chamber;

a piezoelectric transducer having a bottom surface attached to the diaphragm plate, the diaphragm plate including a recess that forms a perimeter around the bottom surface of the transducer, the recess partially underlying at least one edge of the bottom surface;

an inlet channel connected to the pressure chamber and configured to direct ink to the pressure chamber from a manifold;

an outlet channel connected to the pressure chamber and configured to receive ink from the pressure chamber and having a channel axis that is perpendicular to the diaphragm plate, the outlet channel including a first outlet channel section and a second outlet channel section, the first outlet channel section including a plurality of subsections having alternating diameters, the second outlet channel section including an aperture disposed at an end thereof, the second outlet channel section having a substantially continuous cross-sectional shape and a length that is greater than a length of the first outlet channel section.

2. The drop generator of claim 1, the first outlet channel section having a length along the channel axis of approximately 23.0 mil, and the second outlet channel section having a length along the channel axis of approximately 52.0 mil.

3. The drop generator of claim 2, the first subsection having a length along the channel axis of approximately 3.0 mil and a diameter of approximately 8.1 mil, the second subsection having a length along the channel axis of approximately 3.0 mil and a diameter of approximately 13.0 mil, the third subsection having a length along the channel axis of approximately 3.0 mil and a diameter of approximately 9.0 mil, the fourth subsection having a length along the channel axis of approximately 6.0 mil and a diameter of approximately 13.0 mil, the fifth subsection having a length along the channel axis of approximately 1.0 mil and a diameter of approximately 9.0 mil, the sixth subsection having a length along the channel axis of approximately 6.0 mil and a diameter of approximately 13.0 mil, and the seventh subsection having a length along the channel axis of approximately 1.0 mil and a diameter of approximately 9.0 mil.

4. The drop generator of claim 3, the second outlet channel section including a longitudinal subsection and an offset subsection, the longitudinal subsection having a length along the channel axis of approximately 49.0 mil and a diameter of approximately 13.0 mil, the offset subsection having a length along the channel axis of approximately 3.0 mil and a diameter of approximately 14.7 mil, the offset subsection having a center point that is offset from the channel axis.

5. The drop generator of claim 4, the inlet channel having a length extending between the pressure chamber and the manifold of approximately 47.2 mil, a width of approximately 6.0 mil and a thickness of approximately 3.0 mil.

6. The drop generator of claim 5, the piezoelectric transducer having a thickness dimension parallel to the channel axis of the outlet channel of approximately 3.75 mil, a first dimension perpendicular to the channel axis of approximately 28.0 mil, and a second dimension perpendicular to the channel axis of approximately 49 mil.

7. The drop generator of claim 6, the diaphragm having a thickness dimension parallel to the channel axis of the outlet channel of approximately 1.5 mil, a recess that forms a perimeter around the bottom surface of the transducer having a depth of approximately 0.8 mil parallel to the channel axis, a first inner dimension of approximately 25.5 mil perpendicular to the channel axis, a second inner dimension of approximately 45.1 mil perpendicular to the channel axis, and a width of approximately 7.0 mil perpendicular to the channel axis.

8. The drop generator of claim 7, the pressure chamber having a thickness dimension parallel to the channel axis of the outlet channel of approximately 4.0 mil, a first dimension perpendicular to the channel axis of approximately 25.5 mil, and a second dimension perpendicular to the channel axis of approximately 45.1 mil.

9. The drop generator of claim 8, the inlet channel being configured to receive melted solid ink.

10. The drop generator of claim 9, the pressure chamber being operable at a frequency of approximately 1 Hz to approximately 43 kHz.

11. The drop generator of claim 10, the aperture being sized to emit drops having a mass of 22 ng when the pressure chamber operates at a frequency of 43 kHz, and drops having a mass of 18.5 ng when the pressure chamber operates at a frequency less than approximately 38 kHz.

12. The drop generator of claim 1, the first outlet channel section having a sequence of subsections including a first, second, third, fourth, fifth, sixth, and seventh subsection, the first subsection being fluidly connected to the pressure chamber and the seventh subsection being fluidly connected to the second outlet channel section, the first, third, fifth, and seventh subsections each having a diameter that is smaller than a diameter of each of the second, fourth, and sixth subsections.

* * * * *